US005168118A

United States Patent [19]

Schroeder

[11] Patent Number: 5,168,118

[45] Date of Patent: Dec. 1, 1992

[54] METHOD FOR ELECTROMAGNETIC ACCELERATION OF AN OBJECT

[76] Inventor: Jon M. Schroeder, 14301 Bagdad Rd., Leander, Tex. 78641

[21] Appl. No.: 664,136

[22] Filed: Mar. 4, 1991

Related U.S. Application Data

[63] Continuation-in-part of Ser. No. 435,616, Nov. 13, 1989, Pat. No. 5,024,137.

[51] Int. Cl.[5] ..... F41B 6/00

[52] U.S. Cl. ..... 89/8; 124/3; 310/14; 318/135

[58] Field of Search ..... 89/8; 124/3; 244/63; 310/12, 14; 318/135

[56] References Cited

U.S. PATENT DOCUMENTS

| | | | |
|---|---|---|---|
| 3,435,312 | 3/1969 | De Coster | 318/135 |
| 4,714,003 | 12/1989 | Kemeny | 89/8 |
| 4,718,322 | 1/1988 | Honig et al. | 89/8 |
| 4,753,153 | 6/1988 | Jasper | 89/8 |
| 4,754,687 | 7/1988 | Kemeny | 89/8 |
| 4,791,850 | 12/1988 | Minovitch | 89/8 |
| 4,796,511 | 1/1959 | Eyssa | 89/8 |
| 4,817,494 | 4/1989 | Cowan | 89/8 |
| 5,024,137 | 6/1991 | Schroeder | 89/8 |

FOREIGN PATENT DOCUMENTS

| | | | |
|---|---|---|---|
| 1365497 | 5/1964 | France | 124/3 |
| 2211589 | 7/1989 | United Kingdom | 124/3 |

*Primary Examiner*—Stephen C. Bentley
*Attorney, Agent, or Firm*—Joseph F. Long

[57] ABSTRACT

A method for electromagnetic acceleration of an object involving interaction of magnetic forces between magnetic rings on the object to be accelerated and alternating magnetic fields in a ringing circuit formed in each of a series of linearly arranged doughnut shaped accelerator coils with the frequency of the ringing circuit generated in each coil being adjusted according to velocity of the body being accelerated by adjusting the capacitance in each ringing coil circuit; computation being necessary for each particular application to properly match components to achieve desired velocity.

5 Claims, 5 Drawing Sheets

METHOD FOR ELECTROMAGNETIC ACCELERATION OF AN OBJECT

This is a continuation-in-part of my application, Ser. No. 07/435,616 entitled "A Fuel Assisted Electromagnetic Launcher," filing date Nov. 13, 1989, now U.S. Pat. No. 5,024,137.

BACKGROUND

With continuing development work, we find many improvements that may be made in such varied equipment as a nail gun, an earth drill, a space launcher, or an oil well drill using electromagnetic acceleration caused by electromagnetic interaction of magnetic rings around a body to be accelerated and a ringing circuit formed in a D.C. charged accelerator coil. Using a capacitor across inlet charging lines to the accelerator coil and a nano-second switch in one of the lines between the capacitor and charging source a ringing circuit is formed by opening said nano-second switch. A ringing circuit may be likened to an alternating current with frequency of the cycles being dependent upon the particular circuit. With one size of the accelerator coil, the frequency will be more rapid or there will be higher frequency as the capacity of the capacitor in the circuit is decreased. This allows us to arrange coils linearly and choose capacity of each capacitor so that the frequency of the ringing circuit increases to allow maximum propellant or accelerating force between magnetic rings on an object and magnetic forces created by the ringing circuit. Each magnetic ring on an object may be first "pulled" and then "pushed" by electromagnetic interaction with proper ring spacing and proper frequency in the ringing circuit.

There are several ways of forming magnetic rings around the cylindrical object to be accelerated. In one embodiment, conductive rings are formed around the body to be accelerated and a magnetic field is induced in the conductive rings by induction coils positioned close to the conductive rings when the body to be accelerated is held in a pre-acceleration chamber.

In other embodiments, a magnetic field is induced in a segmented ring wherein the segments are of dissimilar metals such as aluminum and nickle and junctions of the segments are alternately heated and cooled We have considered all of the following patents:

| Ser. No. | Inventor | Date |
|---|---|---|
| 4,817,494 | Maymard Cowan | 4/4/1989 |
| 4,796,511 | Yehia M. Eyssa | 1/10/1989 |
| 4,791,850 | Michael A. Minovitch | 12/20/1988 |
| 4,754,687 | George A. Kemeny | 7/5/1988 |
| 4,753,153 | Louis J. Jasper, Jr. | 6/28/1988 |
| 4,718,322 | Emanual M. Honig, et al. | 1/12/1988 |
| 4,714,003 | George A. Kemeny | 12/22/1989 |

None of these make use of a ringing circuit caused by opening of a nano-second switch in charging lines to charge a coil with a capacitor connected across the charging lines between the coil and the nano-second switch. The strength of a magnetic field induced by lines of force is proportional to the change of the voltage with time so that we form a very strong magnetic field in this way. Since the ringing circuit gives an alternating current with a frequency determined by capacitance relative to coil size we may control the frequency as an object procedes through accelerator coils by changing the capacitance of the capacitor in the coil circuit. We may also increase magnetic field strength on one or more magnetic rings on the object to be accelerated. When more than one ring is used spacing of the rings is such as to give propellant "pull" and "push" by interaction of electromagnetic fields on the rings as they are propelled through the accelerator coils.

A further difference from any of these patents is that the object to be accelerated is held in a pre-accelerator chamber to form or induce magnetic fields in the rings. Further, in our invention in some applications the object may be propelled into the accelerator coils using a propellant such as gun powder, rocket fuel or compressed air and in some applications the magnetic field around the rings is produced initially by heating and cooling alternate junctions of dissimilar metals forming the ring. In the embodiment using dissimilar metal rings, the magnetic fields around the rings are increased using an induction coil connected with a nano-second switch that is opened as the magnetic rings pass into the center of induction coils as the object moves toward the accelerator coils. We have shown that additional field strength generated in this manner exists sufficiently long for acceleration.

SUMMARY OF THE INVENTION

The invention encompasses a method for electromagnetic acceleration of a cylindrical object using interaction between a magnetic field or fields around the object and magnetic fields caused by a ringing circuit in each of a multiplicity of induction coils also called accelerator coils.

The object to be accelerated is either formed into a cylinder or placed into a cylinder and equipped with an elongated forward end to act to trigger a sensor such as a photo-electric cell. One or more conductive rings are formed around the cylinder. For maximum efficiency four rings are preferred. As the cylinder is held in a pre-acceleration chamber, current may be induced with resultant magnetic field in these rings by induction coils in the pre-acceleration chamber. In other embodiments, the magnetic field in each of one or more segmented rings with segments of dissimilar metals such as nickle and aluminum is formed by alternately heating and cooling of junctions. Steam, hot gas, or electrical heat, burning fuel, etc., may be used for heating while dry ice, refrigeration unit, cold gas, cold water, etc., are suitable for cooling. In these embodiments, the field strength of the magnetic field in each of the segmented rings is increased by induction coils located at the exit end of the pre-acceleration chamber. This is accomplished by opening nano-second Mos-Fet switches in the induction coil circuits between the D.C. charging source and the induction coil just as the rings on the object being accelerated moves out of the pre-acceleration chamber.

In a preferred embodiment, the object held in the pre-acceleration chamber may be propelled into an acceleration barrel by compressed air. In a second embodiment the object may be propelled into the accelerator barrel by rocket fuel or an explosive charge. In a third embodiment, the object and the accelerator barrel may be in a vertical position and gravity alone is sufficient. In yet a fourth embodiment a restraining trigger to hold the object may be used with simultaneous release of the trigger causing opening of nano-second switches to deactivate induction coils in the pre-acceleration chamber and to activate a first accelerator coil.

An accelerator barrel is connected to and aligned with the pre-accelerator chamber with the opening through the accelerator barrel being sufficient to allow passage of the cylindrical object. The accelerator barrel is formed with a series of linearly arranged doughnut shaped multi-turn conductive coils with a non-conductive spacer separating each coil, with the coils and spacers contained in a cylindrical outer shell. The spacer is equipped with means to sense an object as the tip of the object enters the spacer. In a preferred embodiment we use a photoelectric cell with interruption of the light beam acting to open a MOS-FET nano-second switch in circuitry to an accelerator coil. The elongated forward end of the cylinder being accelerated operates the photoelectric cell. There is a nano-second switch for each accelerator coil.

Each accelerator coil is formed with multiturns of insulated copper wire or insulated copper tape. The coil may be formed so as to allow water cooling on each side of the coil. Connections to a D.C. charging source such as a battery or rectifier of six or more volts are made for each coil and for each coil a capacitor is connected across the leads from the charging source with a MOS-FET nano-second switch in one of the leads between the charging source and the capacitor. When a coil is charged, opening the nano-second switch causes an alternating electromagnetic field with a frequency dependent upon capacity in the circuit to the coil The circuit so arranged is called a ringing circuit. The alternating electromagnetic field may be thought of as a changing magnet arranged as south-north, north-south, south-north, etc. This electromagnetic field interacts to accelerate the cylindrical object with one or more electromagnetic rings by alternately pulling and pushing the magnetic fields on the rings on the object. As the object is accelerated through the accelerator barrel, the frequency of the ringing circuit in each coil must be increased in order to keep accelerating the object. The frequency is increased progressively by decreasing the capacitance of each capacitor associated with each coil from the beginning end of the accelerator barrel to the exit end of the barrel. Our calculations indicate that an object may be accelerated to speeds up to above 20,000 feet per second using a sufficient number of accelerator coils in an accelerator barrel.

DETAILED DESCRIPTION OF THE DRAWINGS

We may best describe equipment used in our method of electromagnetic acceleration by describing the drawings.

Figure 1:
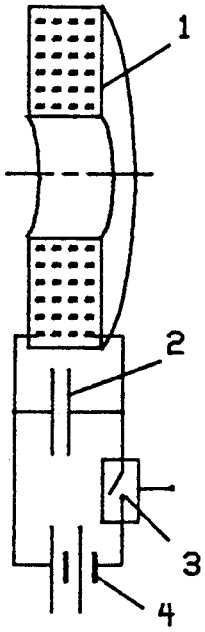
FIG. 1 shows a circuit to form a ringing circuit by opening a nano-second switch.
Figure 2:
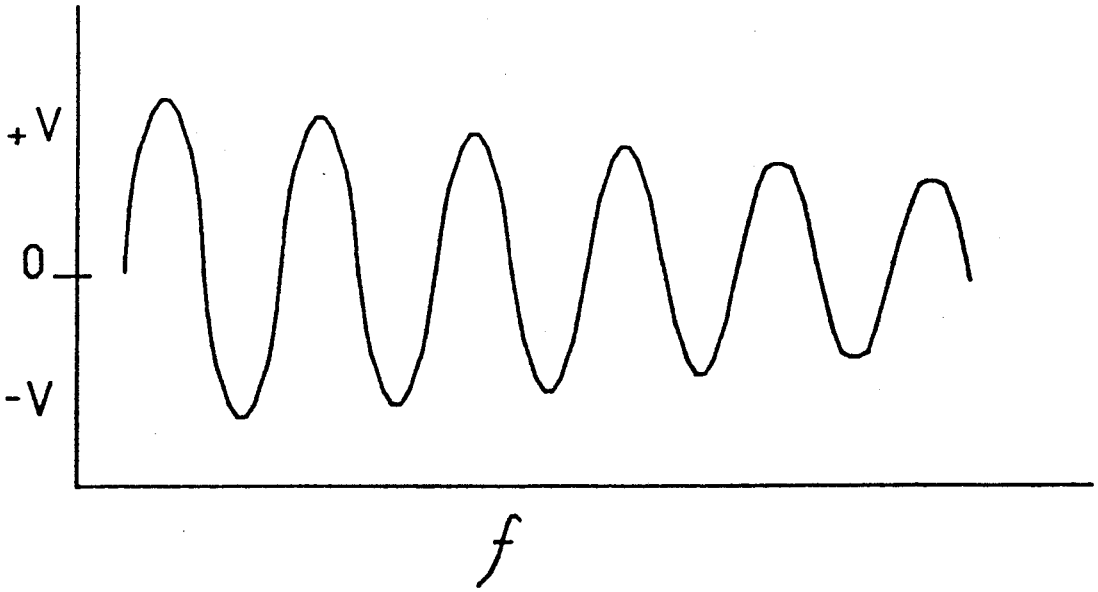
FIG. 2 shows a graph of alternating current frequency in a ringing circuit with one capacitance.

In FIG. 1 we show a coil 1 formed in a doughnut shape from multiple turns of insulated copper wire or copper ribbon; a D.C. charging source such as a 12 volt battery 4, or a rectifier, charges the coil 1 when nano-second switch 3 is closed. A capacitor 2 is connected across the leads to coil 1. With capacitor 2 of one capacitance and coil 1 of a fixed size the frequency of the ringing circuit may be as depicted in FIG. 2 when the nano-second switch 3 is opened.

Figure 3:
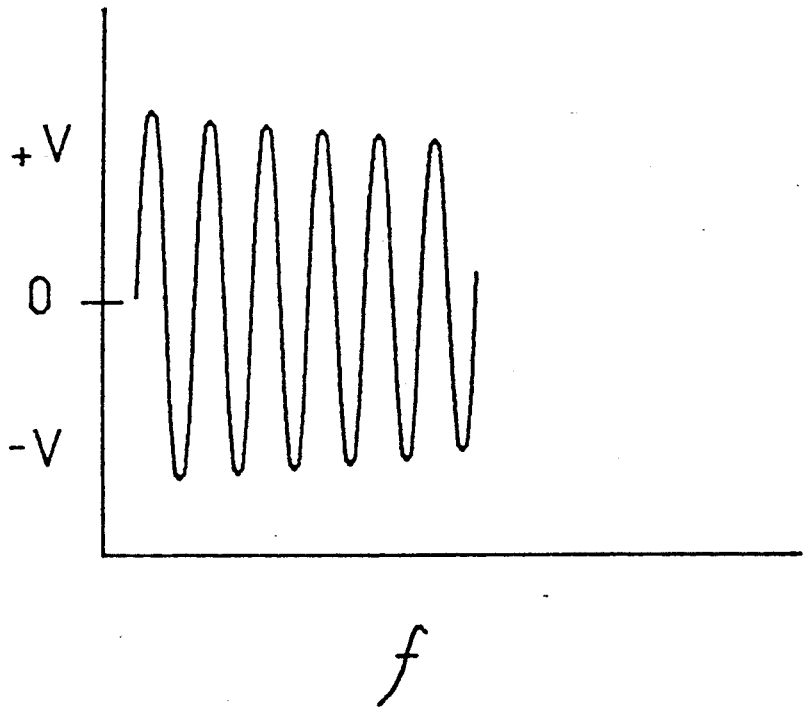
FIG. 3 shows a graph of alternating current frequency in the same ringing circuit as in FIG. 2 when a smaller capacity capacitor or smaller capacitance is used.

In FIG. 3 we indicated the increasing frequency of the ringing circuit formed when capacitor 2 of FIG. 1 is replaced with a smaller capacity capacitor and nano-second switch 3 is opened. This increasing frequency is necessary to continue to accelerate object 5, FIG. 4 as it picks up speed going thru a multiplicity of accelerator coils 1.

Figure 4:
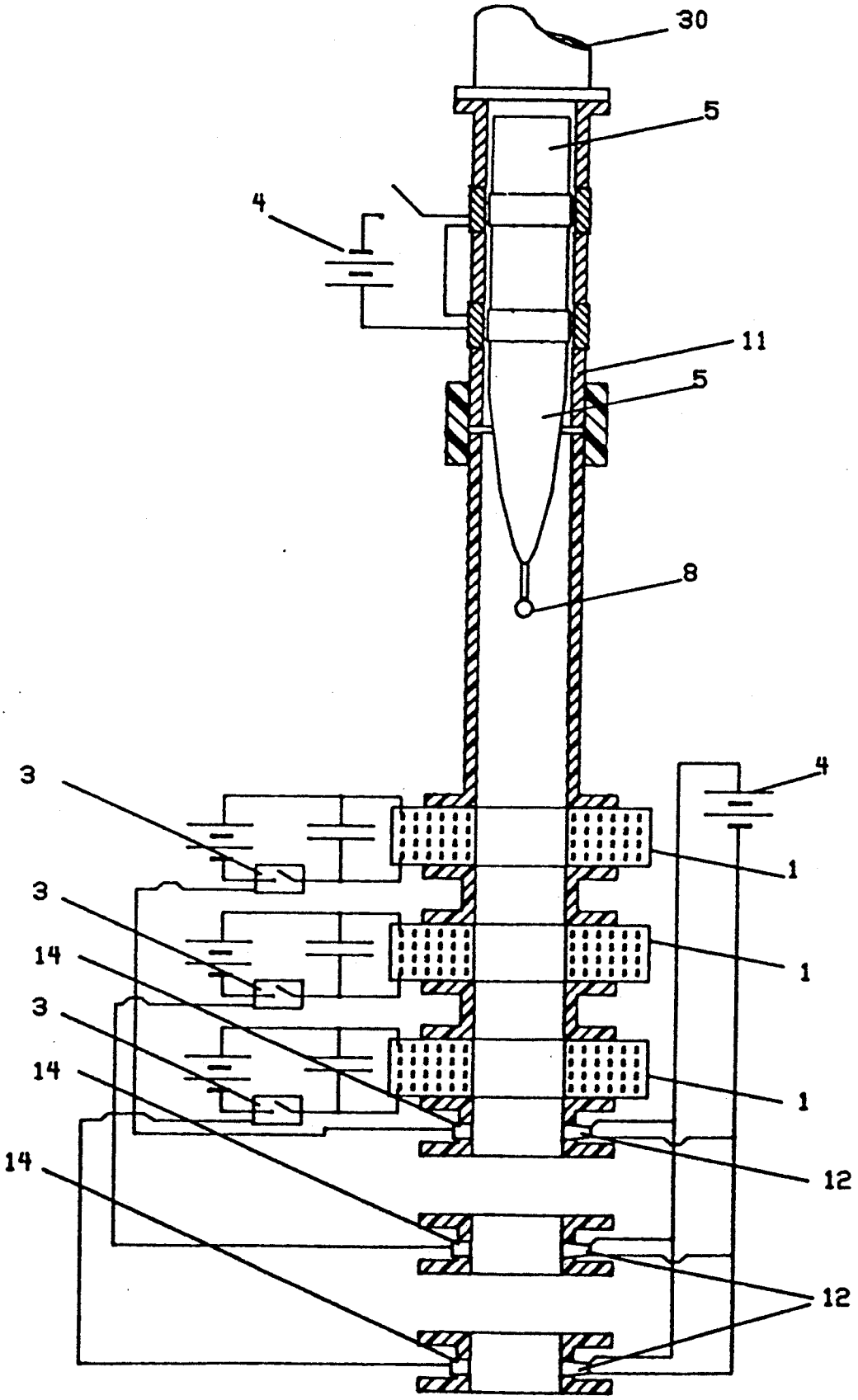
FIG. 4 shows electrical circuitry for the electromagnetic accelerator and for an embodiment wherein magnetic fields of the rings around the object to be accelerated are formed by electrical induction.

In FIG. 4 we show three accelerator coils 1 and connecting circuitry for capacitor 2, charging source 4 and nano-second switch 3. We show three coils for illustration but in many uses the accelerator barrel 10 would contain a multiplicity of coils 1.

In the pre-accelerator chamber 11 we show two conductive rings 6 around the cylindrical object 5 to be accelerated. For maximum efficiency, four rings would be used. In the embodiment shown an electromagnetic field is induced in conductive rings 6 by induction coils 7 when switch 21 is closed to activate induction coils 7.

Cylindrical object 5 may be propelled into the accelerator barrel 10 by compressed air, rocket fuel, or other explosive force, etc., in a conventional manner. As tip 8 enters the first spacer 9 it breaks a light beam from a photoelectric cell light source 12 to photoelectric cell 14 and opens nano-second switch 3 to form a ringing circuit as indicated in FIG. 1. Interaction of the electromagnetic fields generated around coils 1 by the ringing circuit and the alternate N-S, S-N, etc., magnetic fields around ring 6 on object 5 serve to accelerate object 5 in a pull-push fashion.

Spacer rings are sized to hold the accelerator coils 1 a minimum distance apart equal to seventeen hundredths (0.17) of a mean diameter of said accelerator coils 1 to avoid magnetic field interference between accelerator coils.

Figure 5:
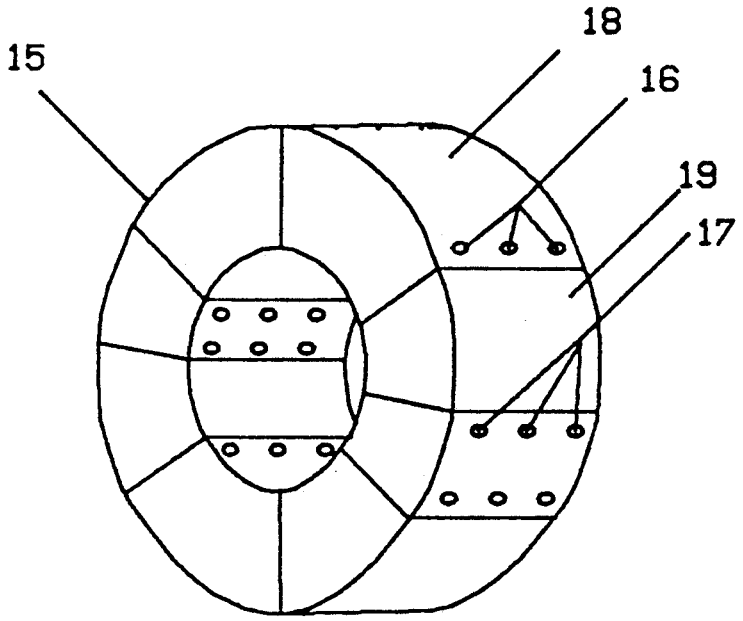
FIG. 5 shows a second embodiment wherein magnetic field of the rings around the object to be accelerated are formed by flowing current when alternate junctions of dissimilar metals such as nickle and aluminum are alternately heated and cooled.

In FIG. 5 we show a segmented ring 15 of dissimilar metals such as aluminum 19 and nickle 18 with holes 16 and holes 17 that may be used for alternately heating and cooling junctions of segments 18 and 19. Heating may be by electrical heaters, hot air, or steam while cooling may be by refrigeration gas, cold water, dry ice, etc. This heating and cooling causes current flow and consequent magnetic fields in the coils.

Figure 6:
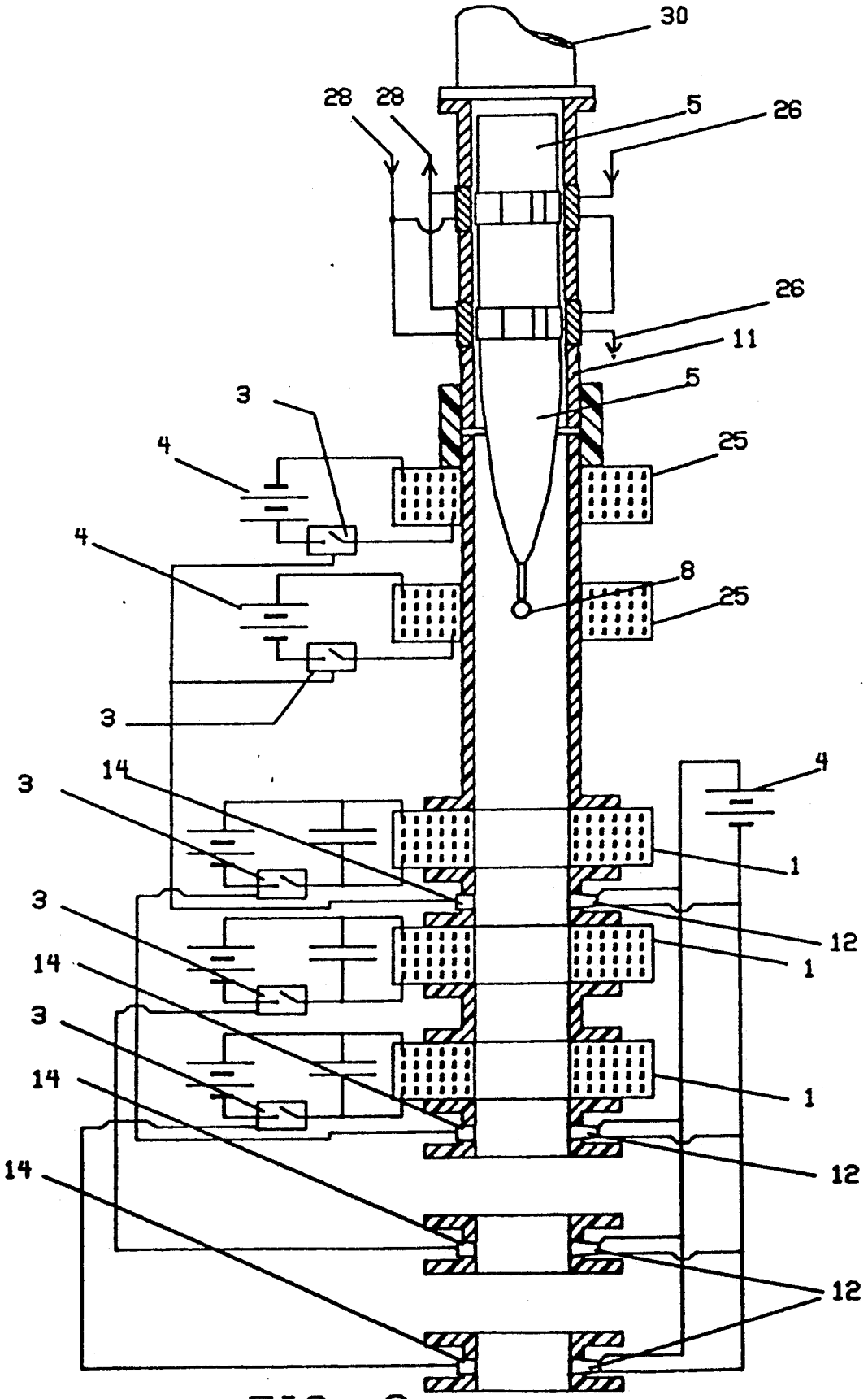
FIG. 6 is similar to FIG. 4 but includes an embodiment wherein strength of the magnetic field caused by current flowing in the rings formed by heating and cooling alternate junctions is increased by opening a nano-second FOS-FET switch in an induction coil circuit just as the rings pass into the induction coils. The induction coils have a spacing exactly equivalent to the ring spacing on the body to be accelerated. Also shown is chamber for admission of compressed air to act as an initial accelerator.

In FIG. 6 we show a second embodiment wherein the magnetic rings 15 are segmented conductive rings as shown in FIG. 5. A current flow and magnetic field is induced in each of the rings 15 by heating and cooling alternate junctions. Where liquid or gaseous coolant medium 26 enters the pre-acceleration chamber 11 to cool junctions on ring 15 an O ring press fit connection is used. Inlet heating medium 28 is similarly connected for heating alternate junctions on ring 15. The coolant medium may be chilled air, chilled water, FREON, a flouro-chloro-ethane coolant, liquid nitrogen, etc. The heating medium may be superheated steam, steam, or heated gas such as air.

Cylindrical body 5 may be propelled forward by compressed air 30. Note that in some cases an explosive propellant or rocket fuel could be used.

As cylindrical body 5 moves forward tip 8 will activate photo-electrical cell receiver 14 by breaking the light path from light 12 and at this point segmented conductive rings 15 will be just under induction coils 25 that are charged by a D.C. source 4. Also exactly at this point Mos-Fet nano-second switches 3 connected with lines to coils 25 will be opened by circuitry from the photo-electric cell receiver 14. Collapsing lines of force induce persistent larger current flow and thereby a stronger magnetic field in coils 15.

As cylindrical body 5 with the stronger magnetic field on rings 15 moves forward tip 8 successively breaks light paths of photoelectric cells in the accelerator barrel and interaction of the magnetic fields of the ringing circuits formed in each accelerator coil 1 with magnetic fields on rings 15 results in magnetic push-pull acceleration as outlined under FIG. 4.

In summary in the electromagnetic acceleration method using equipment as described the object to be accelerated is placed in a pre-acceleration chamber and an electromagnetic field is induced in one or more conductive rings around the object. Accelerator coils are then energized along with photoelectrical cells in the spacers between the accelerator coils. As the tip of the object interrupts the photoelectric cell light beam in the spacer, a nano-second switch in circuitry to a preceding accelerator coil is opened to form a ringing circuit that reacts with magnetic fields on the object to accelerate the object forward. Acceleration is automatic once the light beam is broken in the first spacer. Final acceleration depends upon weight of the object, strength of the interacting magnetic field, entering speed of the body and number of acceleration coils.

What is claimed is:

1. A method for electromagnetic acceleration of a cylindrical object comprising:

a) forming a minimum of one magnetic ring around said object using a minimum of one induction coil;

b) providing a D.C. source and a plurality of linearly arranged doughnut shaped accelerator coils with an interior diameter of said coils being larger than the diameter of said cylindrical object to allow said object to pass through;

c) connecting a capacitor across charging lines from said D.C. source to each of said accelerator coils; each of said capacitors to each of said accelerator coils having a lesser capacity than a preceding one of said capacitors;

d) connecting a nano-second switch in one of said charging lines to each of said accelerator coils between said D.C. source and each of said capacitors;

e) forming an accelerator barrel by arranging and reinforcing said accelerator coils and spacers between said accelerator coils with each of said spacers containing a means to detect a beginning end of said cylindrical object and progressively open said nano-second switches in preceding ones of said accelerator coils thereby forming in each of said coils a ringing circuit, with each ringing circuit having an increasing frequency as said cylindrical object moves through said accelerator barrel;

f) propelling said cylindrical object into a beginning end of said accelerator barrel whereby interaction of magnetic forces produced by a ringing circuit formed by opening said nano-second switches in each of said coils interacts with magnetic forces on said cylindrical object to progressively accelerate said cylindrical object.

2. A method for electromagnetic acceleration of a cylindrical object comprising steps of:

a) forming a minimum of one magnetic ring around said object with said minimum of one magnetic ring being formed by heating and cooling junctions of two dissimilar metals forming said magnetic ring and wherein the magnetic field strength of said magnetic ring is increased by opening a nano-second switch in a line between a charging source and an induction coil as said magnetic ring passes through a central opening in said induction coil;

b) propelling said object into an accelerator barrel; said accelerator barrel comprising:

1) a multiplicity of linearly arranged doughnut shaped accelerator coils with openings to admit said cylindrical object and with each of said coils being separated by a doughnut shaped spacer ring;

2) a means for detecting entrance of said object into said spacer ring and activating a nano-second switch;

3) a D.C. current source connected to charging circuitry with a capacitor across charging lines to each of said accelerator coils and with one of said nano-second switches in one of said charging lines between said D.C. current source and said capacitor for each of said accelerator coils; starting with a first of said capacitors each of said capacitors thereafter having a smaller capacity than a preceding one of said capacitors in order to form a ringing circuit of increasing frequency in each of said coils by opening said nano-second switches as said object proceeds through said accelerator barrel.

3. A method for electromagnetic acceleration of a cylindrical object as in claim 2 wherein said object is propelled into said accelerator barrel using compressed air.

4. A method for electromagnetic acceleration of a cylindrical object comprising:

a) forming a minimum of two magnetic rings around said object;

b) propelling said object into an accelerator barrel; said accelerator barrel comprising:

1) a multiplicity of doughnut shaped accelerator coils linearly arranged;

2) a D.C. source, capacitor, and a nano-second switch in circuitry arranged to allow formation of a ringing circuit in each of said accelerator coils with opening of said nano-second switch;

3) a spacer ring between each pair of said accelerator coils with means to detect said object as it enters said spacer ring and open said nano-second switch;

4) a frequency control means to control frequency in said ringing circuit to allow maximum electromagnetic propellant interaction between said magnetic rings around said object and magnetic fields from said ringing circuit in each of said accelerator coils.

5. A method for electromagnetic acceleration of a cylindrical object as in claim 4 wherein said frequency control means is achieved by starting with a first of said capacitors and decreasing the capacity of each succeeding one of said capacitors to give an increasing frequency in said ringing circuit formed in each of said accelerator coils; said increasing frequency being adjusted by capacitance of said capacitors to provide maximum acceleration from each of said coils as the velocity of said object increases.

* * * * *